US006408858B1

(12) United States Patent
Emmons et al.

(10) Patent No.: US 6,408,858 B1
(45) Date of Patent: Jun. 25, 2002

(54) HAIR CURLER/ROLLER

(75) Inventors: Robert J. Emmons, Farmington; Duane Hein, Monroe, both of CT (US)

(73) Assignee: Remington Corporation, L.L.C., Bridgeport, CT (US)

( * ) Notice: Subject to any disclaimer, the term of this patent is extended or adjusted under 35 U.S.C. 154(b) by 0 days.

(21) Appl. No.: 09/895,731

(22) Filed: Jul. 2, 2001

(51) Int. Cl.[7] ..... A45D 2/20; A45D 2/00; A45D 2/18

(52) U.S. Cl. ..... 132/247; 132/245; 132/246

(58) Field of Search ..... 132/247, 246, 132/245, 250, 273

(56) References Cited

U.S. PATENT DOCUMENTS

| | | | | | |
|---|---|---|---|---|---|
| 876,402 | A | * | 1/1908 | Schacht | 132/247 |
| 957,462 | A | * | 5/1910 | Freeman | 132/247 |
| 1,236,871 | A | | 8/1917 | Richards | |
| 1,847,826 | A | | 3/1932 | Fraser et al. | |
| 1,920,690 | A | * | 8/1933 | Fraser et al. | 132/247 |
| 1,945,932 | A | * | 2/1934 | Caley | 132/247 |
| 2,111,171 | A | * | 3/1938 | Conklin | 132/247 |
| 2,121,476 | A | * | 6/1938 | De La Barre | 132/247 |
| 2,150,871 | A | | 3/1939 | Natkiel | |
| 2,378,872 | A | * | 6/1945 | Stone | 132/247 |
| 2,415,914 | A | * | 2/1947 | Silverman | 132/247 |
| 2,422,716 | A | * | 6/1947 | Broyles | 132/247 |
| 2,484,050 | A | * | 10/1949 | Rivard | 132/247 |
| 3,665,938 | A | | 5/1972 | Pedersen | 132/247 |
| 5,144,968 | A | | 9/1992 | Rivera | 132/247 |
| 6,003,520 | A | * | 12/1999 | Ford | 132/247 |

* cited by examiner

*Primary Examiner*—John J. Wilson
*Assistant Examiner*—Robyn Kieu Doan
(74) *Attorney, Agent, or Firm*—Melvin I. Stoltz

(57) ABSTRACT

By employing the teaching of the present invention, all of the difficulties and drawbacks found in conventional prior art hair curlers/rollers are eliminated. By providing a fully integrated, elongated body member which comprises an elongated central section having a generally rod-like construction, an enlarged loop or eyelet formed at one end of the central section, and elongated continuous, multi-segmented finger member formed at the opposed end of the central section, an easily used, one-piece, clipless hair curler/roller is provided. In addition, all portions of the hair roller/curler are inherently flexible, enabling the central section to be used for receiving the user's hair is wound thereon in the desired manner, and once completely wound thereon, the hair fibers are quickly and easily held in place by flexibly moving the multi-segmented finger member into the loop or eyelet until the hair fibers are locked in place about the central section thereof. Furthermore, the hair curler/roller of the present invention also incorporates color changing, temperature sensitive material formed over a major portion thereof which is constructed for providing a clear, distinctive, and visually recognizable color change. As a result, the use of the hair curler/roller at the appropriate time, or temperature, is easily determined by the user.

24 Claims, 5 Drawing Sheets

HAIR CURLER/ROLLER

TECHNICAL FIELD

This invention relates to hair curlers/or rollers and, more particularly, to flexible hair curlers/rollers which are useable without separate, hair holding clips.

BACKGROUND ART

Numerous hair curler constructions and configurations have been developed over the last many years in an attempt to meet a wide variety of consumer demands for ease of use and styling alternatives. However, in spite of these numerous constructions, all of the requirements sought by consumers have not been satisfied.

One principal requirement which has received little attention is the difficulty and cumbersome procedures required for fastening the hair to the curler once the hair fibers have been wound on the curler. In most instances, separate clips are needed to secure the hair fibers to the roller or curler. However, the use of these clips is difficult for one individual to employ and often require the use of small components which are easily lost, dropped, misplaced, or broken.

Another problem frequently encountered with heated hair rollers is the inability to provide the user with a clear indication of the time when the curler is ready to be used. Although several products have been made available which incorporate a small dot of color changing material which is temperature sensitive, the size of the dot makes it difficult for the user to easily see the color change. In addition, repeated use of the product often reduces the efficacy of the material's temperature sensitivity and its ability to produce a visually distinct color change.

Therefore, it is a principal object of the present invention to provide a hair curler which eliminates the need for any separate and independent fastening member.

Another object of the present invention is to provide a hair curler having the characteristic features described above which also incorporates temperature sensitive, color changing material which is reliable and is readily viewable by the user even after numerous repeated use.

Another object of the present invention is to provide a hair curler having the characteristic features described above wherein the color changing material is formed on a substantial portion of the hair curler.

Another object of the present invention is to provide a hair curler having the characteristic features described above which comprises a one-piece, fully integrated construction, which is easily used by the consumer.

Other and more specific objects will in part be obvious and will in part appear hereinafter.

SUMMARY OF THE INVENTION

By employing the teaching of the present invention, all of the difficulties and drawbacks found in conventional prior art hair curlers/rollers are eliminated, and an easily used, one-piece, clipless hair curler/roller is provided. In addition, the hair curler/roller of the present invention also incorporates color changing, temperature sensitive material formed over a major portion thereof which is constructed for providing a clear, distinctive, and visually recognizable color change. As a result, the use of the hair curler/roller at the appropriate time, or temperature, is easily determined by the user.

In the preferred embodiment of the present invention, the hair curler/roller comprises an elongated central section having a generally rod-like construction. In addition, an enlarged loop or eyelet is formed at one end of the central section, with an elongated continuous, multi-segmented finger member formed at the opposed end of the central section.

By employing this construction, with all portions thereof being inherently flexible, the clipless hair curler/roller of the present invention is realized. In this invention, the central section forms the hair roller portion about which the user's hair is wound in the desired manner. Then, once completely wound thereon, the hair fibers are quickly and easily held in place by flexibly moving the multi-segmented finger member into the loop or eyelet until the hair fibers are locked in place about the central section thereof.

By employing this construction, quick, easy, and rapid fastening of the hair fibers to the curler body is realized in a manner which is simple to employ and completely independent of separate components such as clips with the hair fibers wound on the central section, the multi-segmented finger member which is affixed to one end of the central section, is arcuately pivoted over the central section in overlying, securing, engagement with the hair fibers rolled on the central section. Then, the distal end portions of the multi-segmented finger member is inserted into the loop or eyelet formed at the opposed end of the central section, and advanced therein until securely retained. Once this process is completed, the hair fibers wound on the central section are securely retained in the desired position, in a manner which is quick, easy, and free of additional components.

In order to enable the hair curler/roller of the present invention to operate in the intended manner, the hair curler/roller is preferably formed of flexible material, such as plastic or rubber-based compounds. Although a wide variety of alternate compounds can be employed in the present invention with substantially equal efficacy, the preferred material employed for forming the central section comprises at least once selected from the group consisting of elastomers. Furthermore, the eyelet or loop portion of the hair curler/roller is also preferably formed from the same material as the central section.

In addition, the multi-segmented member of the hair curler/roller of the present invention may also be formed from the same material as the central section. However, in the preferred embodiment, the multi-segmented section is formed from a temperature sensitive material which enables substantially the entire multi-segmented section to change its color in response to temperature changes. In this way, the user obtains an easily seen and understood visual indication when the hair curler/roller has been fully heated and is ready for use.

In this regard, many alternate materials may be employed for forming the multi-segmented section. However, in the preferred embodiment, the multi-segmented section comprises at least one compound selected from the group consisting of elastomers, in order to provide the desired flexibility as well as the color changing effect in response to temperature changes.

As discussed above, the preferred embodiment of the hair curler/roller of the present invention comprises a construction which enables the hair curler/roller to be heated, thereby enabling the user to enjoy the benefits and flexibility provided by heated hair rollers. In order to provide this benefit, the hair curler/roller of the present invention employs temperature-sensitive, color-changing material, as previously detailed. In addition, the hair curler/roller preferably incorporates an elongated, heat-adsorbing rod or coil formed in the central section. By incorporating a heat-adsorbing rod or coil in the hair curler/roller of the present invention, the precisely desired amount of heat is retained by the hair curler/roller for delivery to the hair fibers wound on the central section thereof.

In the preferred embodiment of the present invention, the elongated multi-segmented finger member formed on one end of the central section of the hair curler/roller is preferably constructed with a first, substantially straight portion extending from the central section and a second locking portion extending from the first portion and comprising the multi-segmented configuration. In its preferred construction, the multi-segmented locking portion is preferably formed in a generally sinusoidal shape, incorporating a plurality of peaks and valleys.

As is more fully detailed below, the multi-segmented, section portion of the hair curler/roller of the present invention comprises a generally rectangular cross-sectional shape with the plurality of peaks and valleys being formed on opposed side surfaces thereof. In addition, the other two side surfaces forming the multi-segmented portion are constructed with a substantially flat configuration. Furthermore, each of the peaks and valleys formed on the multi-segmented portion comprises generally curved or rounded shapes, while the sloping walls extending between each peak and valley comprise substantially straight surfaces.

By employing this configuration, a plurality of locking zones are formed along the length of the multi-segmented portion which are capable of securely engaging with the loop eyelet formed at the opposed end of the central portion of the hair curler/roller of the present invention. In this way, a variety of locking areas are provided, enabling the user to quickly and easily insert the multi-segmented portion into the loop eyelet and securely lock the multi-segmented portion therein.

In order to attain the desired locked engagement, two juxtaposed, spaced, adjacent peaks are positioned on opposite sides of the loop or eyelet, with this position being securely retained by placement of the loop or eyelet in the valley of the multi-segmented portion. In this way, the multi-segmented portion is quickly and easily locked in any desired position of the loop or eyelet by one person, without requiring the use of any separate part or component, such as a clip.

By employing this construction, the quick, rapid, and easily attained locked engagement of the multi-segmented portion with the loop or eyelet is realized, and the consumer is able to quickly and easily secure the hair curler to the hair fibers, once the hair fibers have been wound about the central body thereof. Furthermore, no external components are required an a single, integrated hair curler/roller system is realized which provides the desired engagement of the hair curler/roller with the hair fibers.

The invention accordingly comprises a product possessing the features, properties, and the relation of components which will be exemplified in the product hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DISCLOSURE

Figure 1:
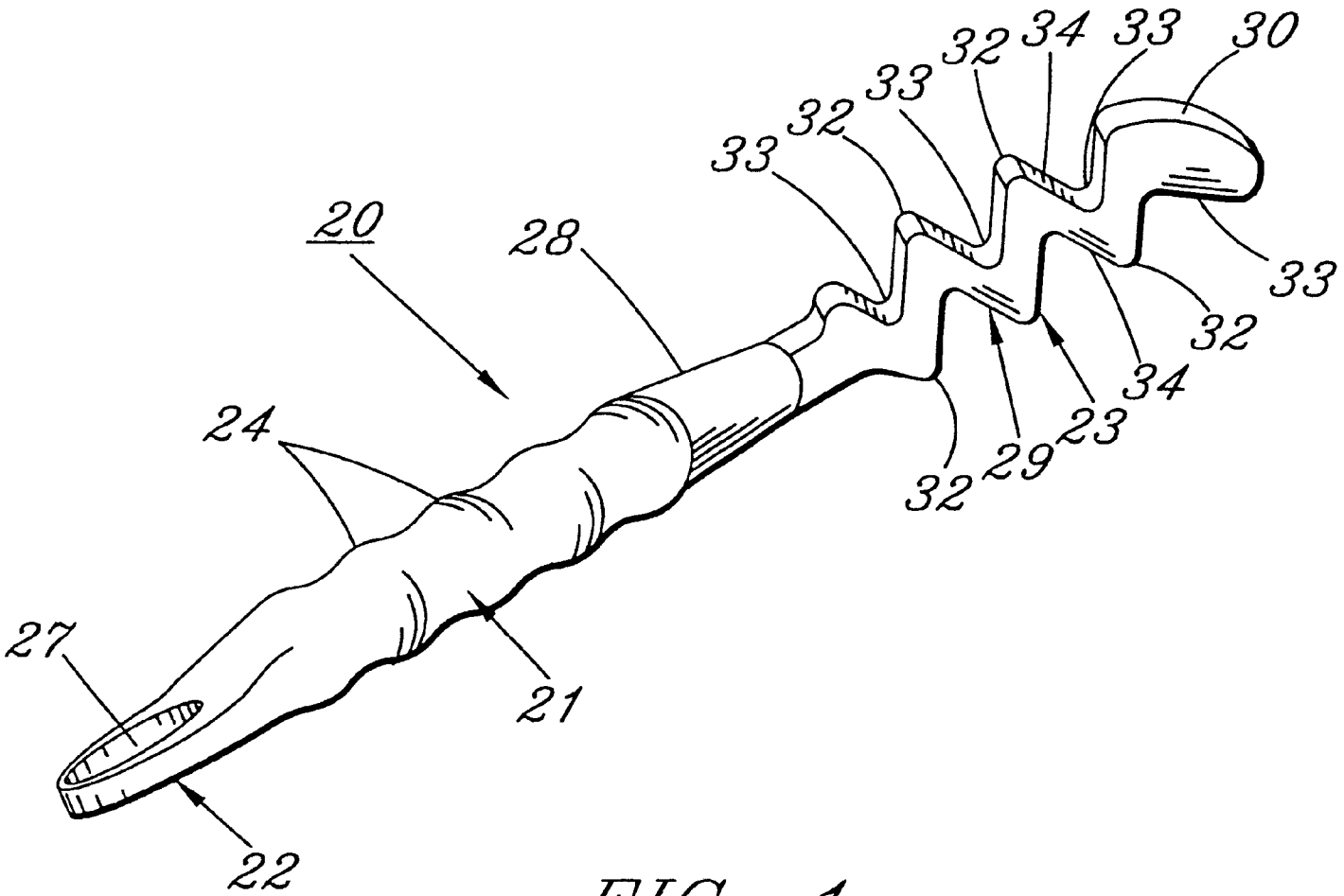
FIG. 1 is a perspective view of the hair curler/roller of the present invention.
Figure 3:
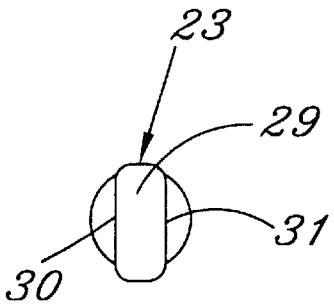
FIG. 3 is an end view of the hair curler/roller of the present invention, looking from the right side of FIG. 2.
Figure 2:
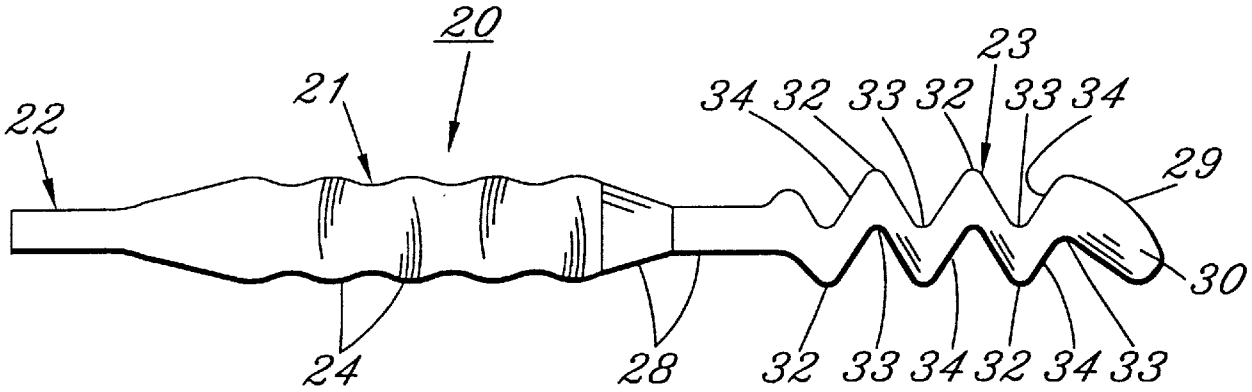
FIG. 2 is a side view of the hair curler/roller of the present invention.
Figure 5:
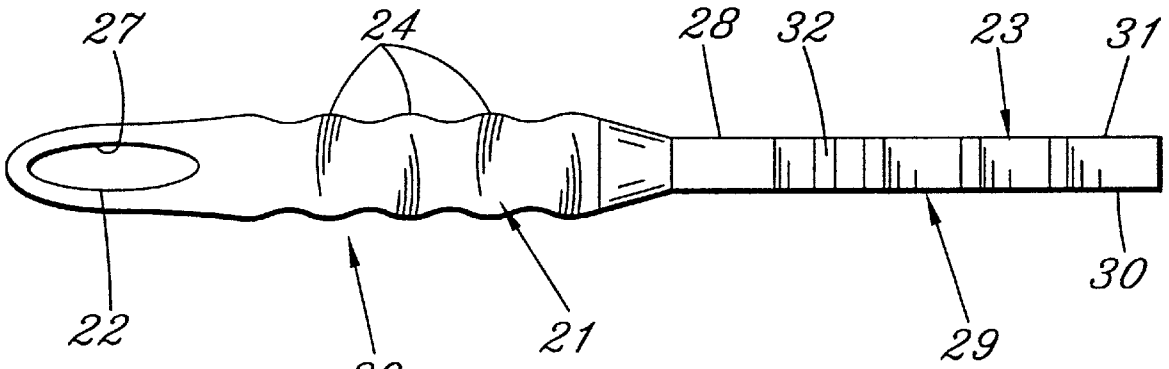
FIG. 5 is a top view of the hair curler/roller of the present invention.
Figure 4:
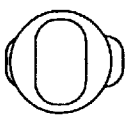
FIG. 4 is an end view of the hair curler/roller of the present invention, looking from the left side of FIG. 2.
Figure 6:
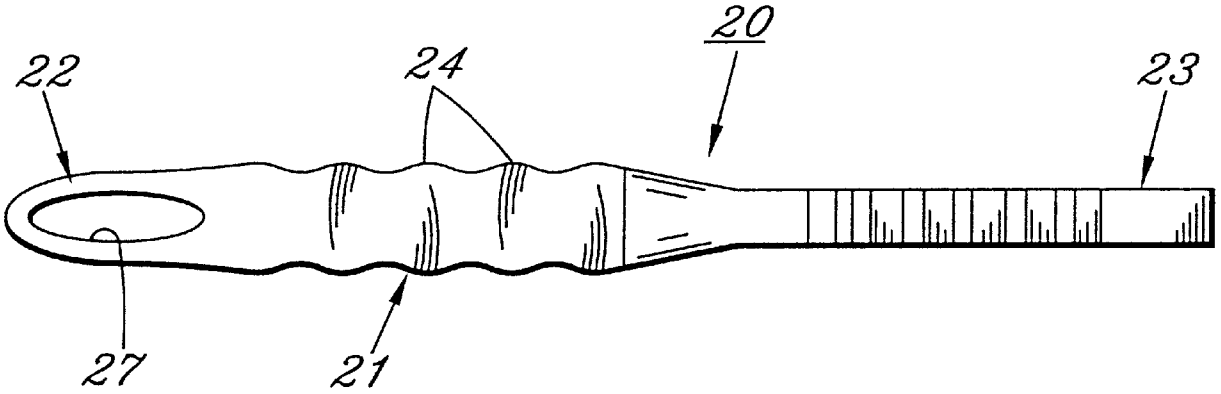
FIG. 6 is a bottom view of the hair curler/roller of the present invention.

By referring to FIGS. 1–9, along with the following detailed disclosure, the construction, operation, and use of the preferred embodiment of the hair curlers/rollers 20 of the present invention can best be understood. As is evident from this disclosure, the present invention may be manufactured using alternate constructions. However, it is to be understood that the embodiment detailed herein for exemplary purposes as representing the preferred embodiment, and all alternate constructions which are evident from this disclosure are intended to be within the scope of the present invention.

As shown in FIGS. 1–9, hair curler/roller 20 preferably comprises a fully integrated product incorporating an elongated, generally cylindrically shaped central section 21, which comprises an enlarged loop or eyelet member 22 formed at one end of central section 21. In addition, an elongated, continuous, multi-segmented finger member 23 is formed at the opposed end of central section 21.

In its preferred construction, central section 21 comprises a generally circular shaped cross-section throughout its length, incorporating a plurality of raised or rounded areas 24 formed therein in juxtaposed, spaced relationship to each other. As is more fully detailed below, by incorporating this preferred construction, secure, wrapped engagement of the hair fibers on central section 21 is attained while also imparting a soft, stylish, curl or set to the hair fibers upon removal of hair curler/roller 20 therefrom.

As best seen in FIGS. 1, 2, 5, and 6, loop or eyelet member 22 extends from one end of central section 21 in integral, interconnected engagement therewith. In addition, in its preferred construction, loop/eyelet 22 incorporates oval-shaped opening 27 formed therein which, as is more fully detailed below, is preferably constructed for co-operative locking engagement with multi-segmented finger member 23. As depicted and detailed herein, although opening 27 preferably comprises an oval-shape, any alternate shaped construction can be employed with equal efficacy. The principal requirement is that opening 27 comprises a shape which enables ease of insertion and locked engagement with multi-segmented finger member 23.

As shown in FIGS. 1–3, 5, and 6, multi-segmented finger member 23 preferably comprises a first, substantially straight portion 27 and a second, locking portion 29 which incorporates a multi-segmented configuration. In addition, finger member 23 is preferably integrally interconnected with central section 21 of hair curler/roller 20, extending from the end of central section 21 which is opposite from loop/eyelet 22.

Furthermore, as depicted, locking portion 29 of finger member 23 preferably comprises a generally rectangular shaped cross-section extending throughout its length which incorporates two substantially flat side surfaces 30 and 31. Completing the generally rectangular shaped member, locking portion 29 of finger member 23 comprises a multi-segmented configuration formed by a plurality of peaks 32 and valleys 33 extending along the opposed two surfaces of second locking portion 29.

In this preferred construction, locking portion 29 comprises an overall visual appearance which comprises a generally sinusoidal shape formed by a plurality of peaks 32 and valleys 33. However, in accordance with the present invention, each peak 32 is interconnected to each adjacent valley 33 by a substantially straight, sloping surface or edge 34.

In most sinusoidal configurations, an arcuate curved zone extends between each peak and valley. However, in accordance with the present invention, the interconnecting zone between each peak 32 and valley 33 comprises a substantially straight, sloping surface 34. As is more fully detailed below, this construction provides the desired locked inter-engagement of locking portion 29 with loop/eyelet 22.

As discussed above, hair curler/roller 20 is employed by winding the desired hair fibers about central section 21. Once the desired length of hair fibers have been wound about central section 21 of hair curler/roller 20, locking portion 29 of multi-segmented finger member 23 is flexibly moved arcuately rearwardly, and inserted through oval-shaped opening 27 of loop/eyelet 22. In addition, a plurality of peaks 32 and valleys 33 are advanced through opening 27, until the desired position is attained.

Figure 8:
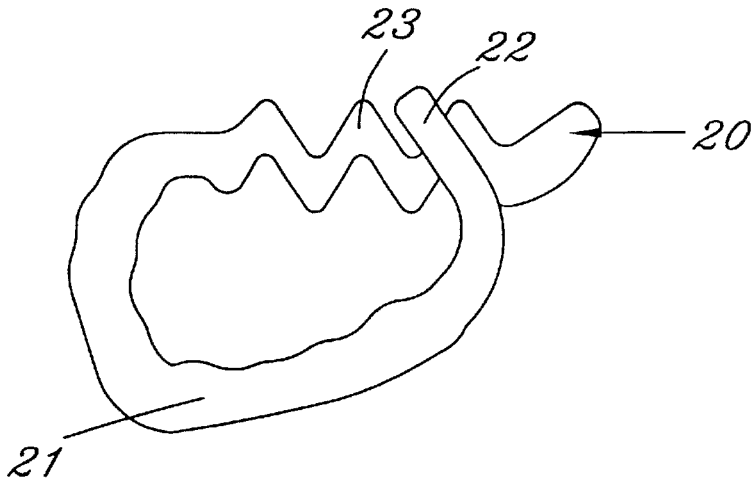
FIG. 8 is a perspective view of the hair curler/roller of the present invention.

Then, fully integrated hair curler/roller 20 is quickly and easily secured in locked engagement with the hair fibers peripherally surrounding central section 21 by positioning two adjacent peaks 32 on opposed sides of loop/eyelet 22, with the intermediate valley 33 engaging the inner surface of opening 27 of loop/eyelet 22. This securely locked and fully engaged configuration is depicted in FIG. 8.

By employing hair curler/roller 20 of the present invention, an individual is able to quickly and easily wrap any desired length of hair fibers about central section 21 of hair curler/roller 20 and then securely place the hair fibers in locked engagement with hair curler/roller 20 by merely flexibly moving multi-segmented finger member 23 into engagement with loop/eyelet 22. In this way, the desired securement of the hair fibers on hair curler/roller 20 is attained with ease and simplicity, without the need for separate and independent fastening members. As a result, consumers are able to enjoy the benefits provided by hair curler/roller 20 of the present invention.

Figure 7:
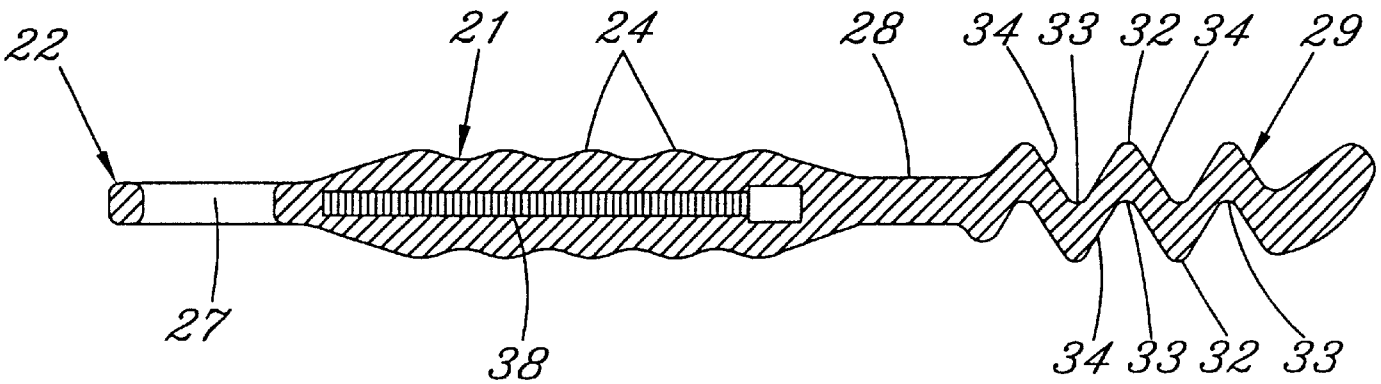
FIG. 7 is a cross-sectional side view of the hair curler/roller of the present invention.

In addition to providing simplicity, ease, and rapid locked inter-engagement of hair curler/roller 20 in the precisely desired position, the preferred embodiment of hair curler/roller 20 of the present invention is also constructed to provide a heated hair roller, thereby increasing the efficacy and styling benefits achieved by the present invention. In order to provide the required level of heat to the hair fibers wound on central section 21 in order to achieve the desired curl formation, hair curler/roller 20 incorporates an elongated heat adsorbing and retaining rod 38 which is mounted in central section 21. In the preferred embodiment, rod 38 comprises an elongated coil spring member embedded in central section 21, as depicted in FIG. 7.

In normal use, an individual winds a plurality of sections of hair fibers forming an individual's head of hair about a plurality of hair curlers/rollers 20. Typically, the hair is wound on curlers/rollers 20 when clean and dry. Due to the chemical composition of the hair fibers, the application of heat causes a curl or set to be imparted to the hair. As a result, a heated hair roller is desirable for for assuring that the precise hair curl configuration sought by the user is imparted to the hair fibers.

Figure 10:
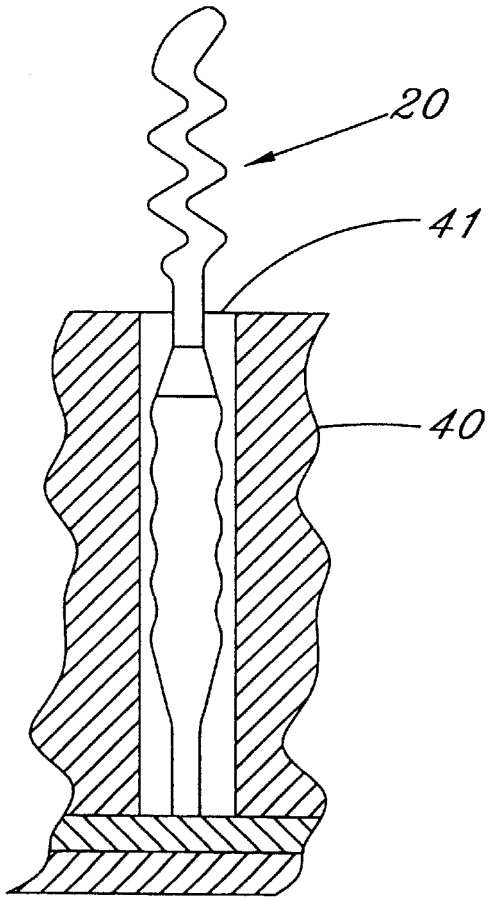
FIG. 10 is a cross-sectional side elevation view, partially broken away, depicting the hair curler roller retained in the housing for heating.
Figure 9:
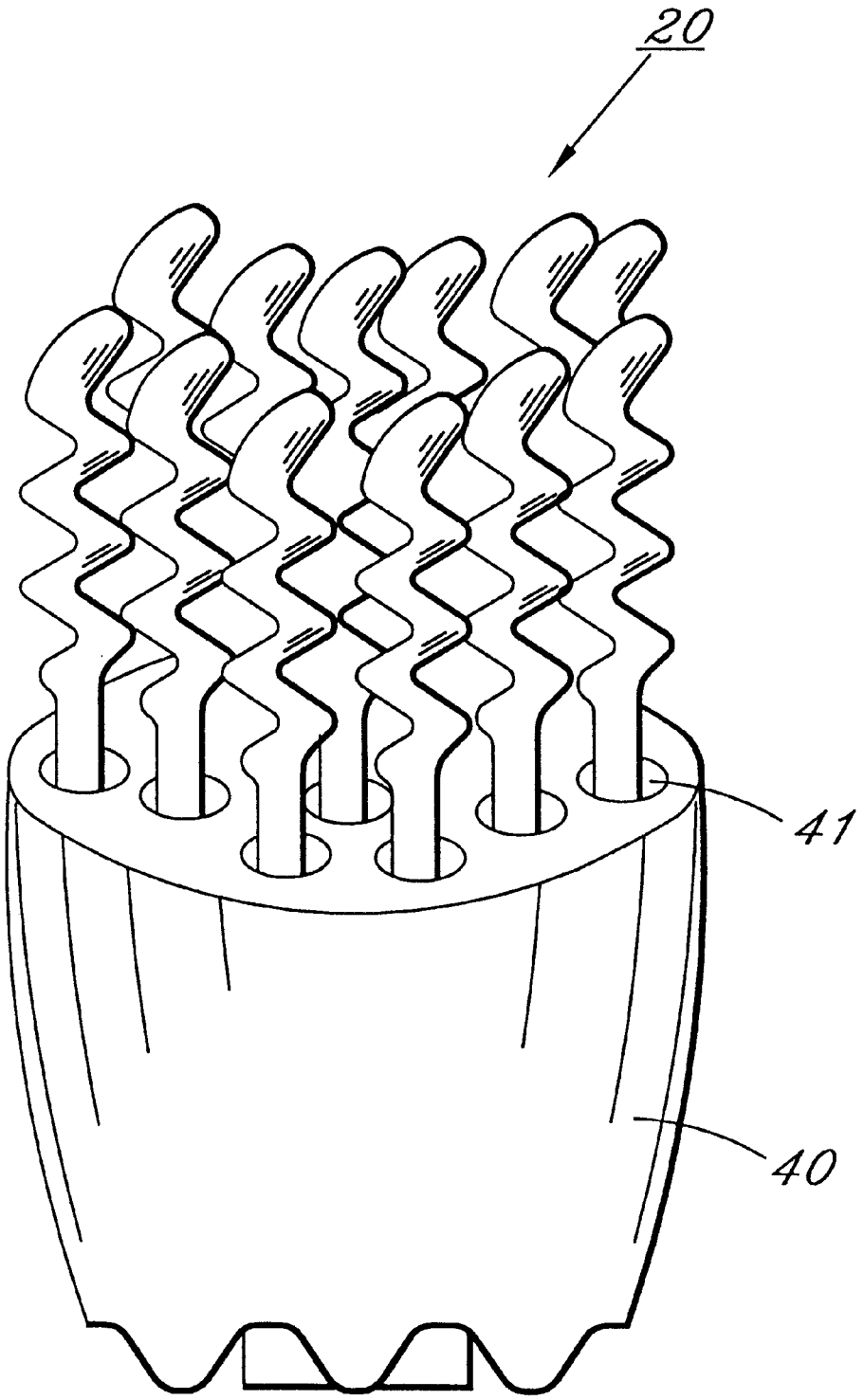
FIG. 9 is a perspective view of the hair curler system of the present with the hair curler/roller for retaining

In order to heat hair curlers/rollers 20 to the desired temperature level for providing a long-lasting curl configuration to the hair fibers of the user, the present invention preferably employs a housing 40, as shown in FIGS. 9 and 10. In the preferred construction, housing 40 incorporates a plurality of receiving zones or cavities 41, each of which are constructed for receiving and securely retaining one hair curler/roller 20.

In addition, housing 40 also incorporates heat producing means formed therein which is constructed for producing the required heating to raise at the temperature level of each hair curler/roller 20 to the precisely desired level. In this regard, in the preferred construction, the heating means is constructed in peripheral surrounding engagement with each receiving zone for each hair curler/roller 20, thereby enabling each hair curler/roller 20 to be directly heated by the heat producing means of housing 40 whenever desired by the user. In this way, the precise amount of heat is imparted directly to each hair curler/roller 20, raising the temperature level of each hair curler/roller by heating rod 38 embedded therein.

As discussed above, each hair curler/roller 20 is formed from flexible rubber, plastic, or elastomeric materials in order to assure that the desired flexibility is easily attained. In this regard, central portion 21 and loop/eyelet member 22 preferably comprises an elastomeric material. In addition, as is evident from the foregoing detailed discussion, this material must be heat resistant for enabling central section 21 and loop/eyelet member 22 to be heated to the desired temperature level.

In addition, multi-segmented finger member 23 is also formed from flexible material, preferably comprising a rubber, plastic, or elastomeric material. In this way, the desired arcuate flexing required for finger member 23 is easily attained. If desired, finger member 23 may be formed from the same material employed for forming central section 21 and loop/eyelet member 22.

In the preferred embodiment of the present invention, multi-segmented finger member 23 incorporates temperature sensitive material which produces a change in color when the temperature level of the material is altered. In the preferred construction, the entire flexible finger member, 23 comprises the temperature responsive material, thereby providing the user with an enlarged area which undergoes a readily visible and easily observed color change whenever the temperature of hair curler/roller 20 is raised.

In the preferred implementation, finger member 23 displays a first uniform color throughout its length when finger member 23 is at room temperature. However, whenever hair curler/roller 20 is positioned in housing 40 in order to raise the temperature of hair curler/roller 20, the color of finger member 23 is changed in its entirety to a second, alternate color. In this way, the user is quickly and easily informed when each hair curler/roller 20 has been heated to the desired level for use in the hair.

In the preferred implementation of the present invention, the color changing material employed for finger member 23 comprises color changing pigments incorporated into the elastomeric material forming finger member 23. Preferably, the color changing pigments employed for finger member 23 provides a distinctive color change in response to being heated from room temperature to a temperature ranging between about 120° and 140° F.

As is evident from the foregoing detailed disclosure, the present invention provides heated hair rollers which are quickly and easily employed by the user and secured in place without requiring separate, independent fastening members. Furthermore, the hair curlers/rollers of the present invention also incorporate temperature responsive, color changing material for enabling a readily distinguishable color to be observed by the user when the hair curler/roller 20 has been heated to the desired temperature for use. As a result, operational ease and safety is provided in a unique, stylish assembly.

Furthermore, in the preferred construction of the present invention, each hair curler/roller comprises a single, elongated, fully integrated product which is retained and a housing for heating in a substantially vertical orientation, thereby enabling heating to be achieved efficiently, while also enabling the finger member of each hair curler/roller 20 to extend outwardly from the housing. In this way, the visibility of the finger member is enhanced for observing the color change.

It will thus be seen that the object set forth above, among those made apparent from the preceding description, are efficiently as attained and, since certain changes may be made in the above product without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A one-piece, clipless hair roller or curler constructed for ease of use and comprising a single, substantially continuous body member incorporating A. an elongated, central section having
   a. a first end and a second end, each of which are formed on opposed surfaces of the central section,
   b. a generally cylindrical shape comprising a substantially circular shaped cross-section throughout its length and incorporates a plurality of rounded zones formed thereon in juxtaposed, spaced relationship for providing hair curling effects to the hair fibers wound thereon;

B. a latching member
   a. formed at the first end of the elongated central section,
   b. constructed for mating, locking engagement with a finger portion; and
   c. comprising a closed loop or eyelet having a generally oval shape;

C. an elongated finger portion
   a. formed at the second end of the central section;
   b. comprising a substantially rectangular cross-sectional shape, having substantially flat, opposed side surfaces and incorporating a plurality of independent locking zones formed along the length thereof, with each of said locking zones comprising a substantially "V" shape for providing locking engagement with a portion of the oval-shaped loop or eyelet, and
   c. constructed for being arcuately pivoted from a first curler open position to a second curler closed position, wherein at least one of said locking zones is securely engaged with the latch member of the curler; and D. an elongated, flexible rod mounted in the central section for imparting strength, rigidity and flexibility thereto;

whereby hair fibers wound about the central section of the curler are quickly and easily securely held in place by merely arcuately pivoting the elongated finger portion from its first position to its second, locked and engaged position.

2. The hair roller/curler defined in claim 1, wherein the central section is further defined as comprising a generally cylindrical shape.

3. The hair roller/curler defined in claim 2, wherein the latch member comprises a closed loop or eyelet construction for receiving and securely retaining the locking zones of the finger portions.

4. The hair roller/curler defined in claim 1, wherein the latching member is further defined as comprising an oval-shaped loop or eyelet.

5. The hair roller/curler defined in claim 4, wherein the finger portion comprises a plurality of independent sections, each of which forms one of the locking zones.

6. The hair roller/curler defined in claim 1, wherein each independent section of the finger portion comprises a substantially "V" shaped construction for providing locking engagement with a portion of the oval-shaped loop or eyelet of the latch member.

7. The hair roller/curler defined in claim 6, wherein said curler/roller comprises a substantially unitary, fully integrated construction in enabling hair fibers to be wound about the central section and securely retained thereon by arcuately pivoting the elongated finger portion from its first position into locked interengagement with the latch member.

8. The hair roller/curler defined in claim 1, wherein said central section is further defined as comprising a substantially circular shaped cross-section throughout its length and incorporates a plurality of rounded zones formed thereon in juxtaposed, spaced relationship for providing hair curling effects to the hair fibers wound thereon.

9. The hair roller/curler defined in claim 1, wherein said elongated finger portion comprises a substantially rectangular cross-sectional shape, having substantially flat, opposed side surfaces, thereby assuring secure locking engagement in said latch member.

10. The hair roller/curler defined in claim 1, wherein the "V" shape construction of said elongated finger portion is further defined as comprising a substantially sinusoidal shape having a plurality of peaks and valleys, with each peak and valley thereof defining a locking zone for interengagement with a portion of the latch member.

11. The hair roller/curler defined in claim 1, wherein said continuous body member is further defined as being formed from flexible material in order to assure ease of operation and arcuate pivotability thereof.

12. The hair roller/curler defined in claim 1, wherein said flexible material is further defined as comprising one selected from the group consisting of plastics and rubber based compounds.

13. The hair roller/curler defined in claim 11, and further comprising an elongated, flexible rod mounted within said central section thereof for imparting additional strength, rigidity, and flexibility thereto.

14. The hair roller/curler defined in claim 1, wherein said elongated, flexible rod is further defined as comprising a heat sink for receiving heat from a heat source and retaining the heat for an extended period of time.

15. The hair roller/curler defined in claim 14, wherein said flexible rod enables the central section of the hair roller/curler to be heated from ambient conditions to a temperature ranging between about 100° and 140°0 F.

16. The hair roller/curler defined in claim 14, wherein said finger portion is further defined as being formed from temperature sensitive material which is responsive to temperature variations by changing the entire surface color thereof.

17. A one-piece, clipless hair roller or curler constructed for ease of use and comprising a single, substantially continuous body member incorporating A. an elongated, central section having a first end and a second end, each of which are formed on opposed surfaces of the central section;

B. a latching member
   a. formed at the first end of the elongated central section,
   b. constructed for mating, locking engagement with a finger portion; and
   c. comprising a closed loop or eyelet;

C. an elongated finger portion
   a. formed at the second end of the central section;
   b. comprising a plurality of independent locking zones formed along the length thereof, with each of said locking zones comprising a substantially "V" shape, and
   c. constructed for being arcuately pivoted from a first curler open position to a second curler closed position, wherein at least one of said locking zones is securely engaged with the latch member of the curler; and D. an elongated, flexible rod
   a. mounted in the central section for imparting strength, rigidity and flexibility thereto, and
   b. forming a heat sink for receiving heat from a heat source and retaining the heat for an extended time period;

whereby hair fibers wound about the central section of the curler are quickly and easily securely held in place by merely arcuately pivoting the elongated finger portion from its first position to its second, locked and engaged position.

18. The hair roller/curler defined in claim 17, wherein said flexible rod enables the central section of the hair roller/curler to be heated from ambient conditions to a temperature ranging between about 100° and 140° F.

19. The hair roller/curler defined in claim 18, wherein said finger portion is further defined as being formed from temperature sensitive material which is responsive to temperature variations by changing the entire surface color thereof.

20. A heated hair curling system comprising:

A. a housing incorporating a plurality of separate receiving zones, each of which incorporate heat producing means for delivering heat to any member mounted therein; and B. a plurality of one-piece, clipless hair rollers or curlers, constructed for ease of use and each comprising a single, substantially continuous body member constructed for removable mounted engagement in one of said receiving zones of the housing and incorporating
   a. an elongated, central section having a first end and a second end, each of which are formed on opposed surfaces of the central section;
   b. a latching member
      1. formed at the first end of the elongated central section, and
      2. constructed for mating, locking engagement with a finger portion;
   c. an elongated finger portion
      1. formed at the second end of the central section;
      2. comprising a plurality of locking zones formed along the length thereof, and
      3. constructed for being arcuately pivoted from a first curler open position to a second curler closed position, wherein at least one of said locking zones is securely engaged with the latch member of the curler; and D. an elongated, flexible rod
   b. mounted in the central section for imparting strength, rigidity and flexibility thereto, and
   c. forming a heat sink for receiving heat from said heat producing means of said housing and constructed for retaining the heat for an extended time period;

whereby a heated hair curling system is attained wherein the plurality of hair rollers/curlers are heated to a desired temperature and then removed for use.

21. The heated hair curling system defined in claim 20, wherein the finger portion of each of said hair curlers/rollers is further defined as being formed from temperature sensitive material which is responsive to temperature variations by changing the entire surface color thereof.

22. The hair roller/curler defined in claim 17, wherein the "V" shape construction of said elongated finger portion is further defined as comprising a substantially sinusoidal shape having a plurality of peaks and valleys, with each peak and valley thereof defining a locking zone for interengagement with a portion of the latch member.

23. The hair roller/curler defined in claim 17, wherein said continuous body member is further defined as being formed from flexible material in order to assure ease of operation and arcuate pivotability thereof.

24. The hair roller/curler defined in claim 17, wherein said flexible material is further defined as comprising one selected from the group consisting of plastics and rubber based compounds.

* * * * *